US006568658B2

(12) United States Patent
Strome

(10) Patent No.: US 6,568,658 B2
(45) Date of Patent: May 27, 2003

(54) QUICK-CONNECT RAILING CONNECTOR

(75) Inventor: Gary F. Strome, Denver, CO (US)

(73) Assignee: CraneVeyor Corporation, South El Monte, CA (US)

( * ) Notice: Subject to any disclaimer, the term of this patent is extended or adjusted under 35 U.S.C. 154(b) by 0 days.

(21) Appl. No.: 09/747,305

(22) Filed: Dec. 22, 2000

(65) Prior Publication Data

US 2002/0079482 A1 Jun. 27, 2002

(51) Int. Cl.[7] ..... E04H 17/22; E04H 17/00

(52) U.S. Cl. ..... 256/65.14; 256/65.02; 256/59; 403/409.1

(58) Field of Search ..... 256/65.02, 65.14, 256/65.01, 59; 403/409.1

(56) References Cited

U.S. PATENT DOCUMENTS

| | | | | |
|---|---|---|---|---|
| 755,442 | A | 3/1904 | Brickell | |
| 764,054 | A | 7/1904 | Houdlette | |
| 2,182,797 | A | 12/1939 | Dillon | 285/193 |
| 2,479,960 | A | 8/1949 | Osborn | 285/193 |
| 2,590,565 | A | 3/1952 | Osborn | 285/196 |
| 2,738,992 | A | 3/1956 | Heisler | 285/59 |
| 2,914,344 | A | 11/1959 | Anthes | 285/93 |
| 3,479,068 | A | 11/1969 | Brittain | 285/321 |
| 3,600,010 | A | 8/1971 | Downs, III et al. | 285/96 |
| 3,637,239 | A | 1/1972 | Daniel | 285/93 |
| 3,674,293 | A | 7/1972 | Parsons | 287/56 |
| 3,692,336 | A | 9/1972 | Zon | 285/175 |
| 3,787,131 | A | 1/1974 | Reachek | 403/234 |
| 3,855,896 | A | 12/1974 | Kaufman | 85/78 |
| 3,871,691 | A | 3/1975 | Takagi et al. | 285/321 |
| 3,873,220 | A | 3/1975 | Kashiwabara | 403/172 |
| 3,977,800 | A | 8/1976 | Cassel | 403/172 |
| 4,027,987 | A | 6/1977 | Berkowitz | 403/172 |
| 4,053,247 | A | 10/1977 | Marsh, Jr. | 403/279 |
| 4,087,120 | A | 5/1978 | Rumble | 285/39 |
| 4,120,521 | A | 10/1978 | Parmann | 285/113 |
| 4,138,146 | A | 2/1979 | Rumble | 285/39 |
| 4,146,341 | A | 3/1979 | Smith | 403/174 |
| 4,236,846 | A | 12/1980 | Barton | 403/298 |
| 4,386,870 | A | 6/1983 | Baroody | 403/234 |
| 4,401,324 | A | 8/1983 | Rumble | 285/90 |
| 4,407,482 | A | 10/1983 | Daghe et al. | 251/148 |
| 4,466,600 | A | 8/1984 | Tuttle | 256/65 |
| 4,540,307 | A | 9/1985 | Hollaender, II et al. | 403/190 |
| 4,606,559 | A | 8/1986 | Rammelsberg | 285/39 |
| 4,714,369 | A | 12/1987 | Souza, Jr. | 403/190 |
| 5,024,469 | A * | 6/1991 | Aitken et al. | 285/302 |
| 5,176,414 | A | 1/1993 | Daniele | 285/321 |

(List continued on next page.)

FOREIGN PATENT DOCUMENTS

DE 858164 A1 * 7/1949

*Primary Examiner*—Lynne H. Browne
*Assistant Examiner*—Ernesto Garcia
(74) *Attorney, Agent, or Firm*—Fulwider Patton Lee & Utecht, LLP

(57) ABSTRACT

A connector for use in assembling railings. The connector includes a cylindrical shank for slip fit receipt inside a hollow section of a railing component. The shank has at least one groove having an abutment portion, a seating area, and a tapered portion. An O-ring with an outside diameter larger than the shank and larger than the inside diameter of the railing is set into the seating area of each tapered groove. Proximal movement of the railing component onto the shank of the connector during initial mounting presses the O-rings against the abutment portions and compresses them into the grooves. Subsequent distal movement of the railing component causes the O-rings to ride up the tapered portions of the grooves due to the friction with the inner surface of the railing component being mounted on the shank. The O-rings subsequently wedge between the outside surface of the shank and the inside surface of the railing component locking together the railing component and the connector.

5 Claims, 5 Drawing Sheets

U.S. PATENT DOCUMENTS

| | | | | |
|---|---|---|---|---|
| 5,226,682 | A | | 7/1993 | Marrison et al. ..... 285/308 |
| 5,261,647 | A | | 11/1993 | Venegas, Jr. et al. ..... 256/131 |
| 5,328,215 | A | | 7/1994 | Grenier ..... 285/318 |
| 5,350,203 | A | | 9/1994 | McNaughton et al. ..... 285/319 |
| 5,419,594 | A | | 5/1995 | Nelms ..... 285/315 |
| 5,556,218 | A | | 9/1996 | Homer ..... 403/170 |
| 5,588,685 | A | | 12/1996 | Folkers ..... 285/94 |
| 5,615,968 | A | | 4/1997 | Verenski et al. ..... 403/312 |
| 5,671,955 | A | | 9/1997 | Shumway ..... 285/305 |
| 5,683,116 | A | | 11/1997 | Folkers ..... 285/18 |
| 5,765,812 | A | * | 6/1998 | Guenther ..... 256/65 X |
| 5,816,625 | A | | 10/1998 | Clarke ..... 285/305 |
| 5,897,060 | A | | 4/1999 | Kon et al. ..... 239/223 |
| 5,918,914 | A | | 7/1999 | Morris ..... 285/351 |
| 5,927,411 | A | | 7/1999 | Sheirer ..... 175/417 |

* cited by examiner

QUICK-CONNECT RAILING CONNECTOR

BACKGROUND

The present invention is generally directed to tubular handrail structures and, more particularly, to a quick-connect connector for the interconnection of tubular handrail members.

Tubular handrails are commonly used in shopping malls, office buildings, factories, parking lots, stadiums, balconies, and in many other places where it is desirable to offer a supporting structure for pedestrians in case it should it be needed or to protect people from potentially hazardous conditions. Tubular handrail structures typically comprise prefabricated rail members horizontally disposed, or at least located parallel to the path of travel of the user, and corner, support post, and other members designed to interconnect with and support the rail members. The rail members are typically hollow tubes of a corrosion resistant material and must be supported at each end. The hollow feature results in reduced weight and the length of the rails is limited to avoid bowing. At each of their ends, the rail members are connected to a vertical post typically anchored to a solid base, such as the ground.

These prefabricated members are typically joined together to form the handrail at an installation site through the use of welding, adhesive bonding, or mechanical fasteners, such as threaded parts. While welding, adhesive bonding, and mechanical fasteners generally provide strong and reliable connections, each method has certain drawbacks. Welding, for example, is time consuming and expensive and requires skilled workmen and special equipment. Further, a weld is a permanent connection and a weld-connected structure is generally a permanent structure and is confined to use where it was constructed, unless it is small enough to be portable.

The traditional threaded technique used in the past for many handrails also has disadvantages. For example, in one such threaded approach the rails comprise pipe that is threaded at each end and the vertical posts include female threaded connectors. The rails are screwed into the female connectors during assembly and then the vertical posts are securely mounted to the ground surface. Threaded pipe is expensive and time consuming from both the standpoint of the expense needed to provide the threads on the pipe, as well as the time needed to thread the pipe into the fitting to establish a connection. Such construction requires the use of wrenches for turning the rails into the threads of the post, and the rail must be screwed into posts at both ends at the same time, making the process somewhat difficult.

A wide variety of mechanical fastening devices have been developed to interconnect handrail members in addition to the typical threaded approaches. Although many of these mechanical devices are quite effective in that they firmly clamp or otherwise connect the various parts together and are durable, they are also cumbersome. Some involve the transport of many additional parts to the installation site. Others involve bolt heads and/or clamp plates that protrude from the handrails creating a possible safety concern and an unsightly visual appearance. Protruding bolt or screw heads can cause injury if not rounded or made blunt. Rounded or blunt heads can make it difficult to obtain enough torque for assembly. Even the traditional pipe thread approach does not result in a smooth appearance although it does result in a robust railing structure.

One such device is shown and described in U.S. Pat. No. 5,615,968 entitled "Hand Rail Coupler System," issued to Verenski et al., Apr. 1, 1997. Verenski describes joining a pair of handrail sections by fitting a center member inside the two sections to be joined and fitting a pair of clamp-plates about the exterior of the sections. A through-bolt is used to generate compressive force between the clamp-plates and the sections to be connected, with the center member providing internal reinforcement. However, the cap end of the bolt remains outside the tubes and is exposed to the user, creating a possible hazard and lacking a streamlined appearance.

Wedge blocks with draw-bolts are also commonly used to interconnect corner or branch handrail members with straight handrail members. An example of this approach is described in U.S. Pat. No. 5,556,218, entitled "Tubing Connector," issued to Horner, Sep. 17, 1996. In Horner, a corner member is formed with a wedge end-fitting and a separate wedge block. The wedge block is threaded to accept a draw-bolt while the wedge includes a clearance hole for the draw-bolt. The draw-bolt is inserted from the corner member through the wedge and is threaded into the wedge block. The wedge and wedge block assembly are then slid into a straight member. As the draw-bolt is tightened, the wedge forces the wedge block to expand against the walls of the straight member creating a tight friction fit which holds the wedge block within the straight member, thereby forming a joint between the corner member and the straight member. While it would appear that this mechanism is capable of firmly clamping the parts together, it is relatively complex and requires a relatively large number of parts. Bolt ends must be accessible for controlling the clamping action.

In many cases, it is desirable to have a decorative railing with smooth, continuous joints where the exterior surfaces of the pipe and fitting meet. Inexpensive, reliable, and aesthetically pleasing fittings of a slip-on type for connecting lengths of structural pipe to each other and to structural members are desirable. However, many prior art devices use expansion fittings such as internal expanding parts, or other complicated mechanisms. Such approaches degrade the reliability of the structure due to the relatively large number of parts, each of which may fail or be improperly installed. Smooth, aesthetically pleasing handrails have the added advantage of not having protrusions that can cause cuts or bruises to hands that may be slid along the rails. Previously, handrails with a seamless or near-seamless appearance have only been obtainable through the use of welded or bonded connections, that require skilled assembly, as discussed above, or with relatively complex mechanical devices requiring an undesirable large number of parts and assembly labor.

It would be desirable to maintain the rail members as structurally simple as possible and provide a fitting at the vertical posts that provide a configuration for allowing a quick connection of the rails to the posts.

Hence, those skilled in the art have recognized the need for an improved means of interconnecting handrail components while keeping the handrail or railing design simple and with as few parts as possible. Preferably such a design would comprise a connector that could interconnect handrail components without requiring welding, bonding, or the use of threaded mechanical fasteners. Further, such a device should be reliable, allow easy and rapid installation, and should be relatively inexpensive to manufacture. A need has also been recognized for connectors and railing components that present a smooth outer surface when assembled that is both aesthetically pleasing and is decorative. The present invention fulfills these and other needs.

SUMMARY OF THE INVENTION

The present invention is directed to a connector for connecting to another component having a hollow section for receiving the connector. The connector in accordance with aspects of the invention includes a shank having at least one groove and an O-ring positioned in that groove.

In more detailed aspects, the railing connector in accordance with the invention comprises a shank, the shank having an outer diameter that is less than the inner diameter of the railing component to be mounted on the shank, a proximal end and a distal end for receiving the railing component over the shank, the shank having an annular groove, wherein the annular groove includes a bulkhead and a tapered portion with the bulkhead located closer to the proximal end and the tapered portion tapering outward toward the distal end, and an O-ring having an outer diameter that is larger than the outer diameter of the shank and being disposed in the annular groove, wherein when the railing component is received over the shank, the O-ring is moved against the bulkhead of the groove permitting the railing component to be moved proximally over the shank into a selected mounting position and when the railing component is moved in the distal direction, the O-ring moves up the taper of the groove and is wedged against the inner surface of the railing component thereby opposing further distal movement of the railing component.

In yet more detailed aspects, the annular groove has a seating area with the bulkhead being located proximal to the seating area and the taper of the groove being located distal to the seating area, the seating area having a size selected to receive the O-ring. In another aspect the seating area has a width approximately equal to the width of the O-ring and the seating area has a depth approximately equal to the inner diameter of the O-ring. Further, the annular groove has a seating area within which the O-ring rests, the seating area being located at a portion of maximum depth of the groove.

In yet other aspects, the seating area of the annular groove has a width within the range of about one half to about the full thickness of the O-ring. In more detailed aspects, the groove has a size selected to accommodate O-rings of different sizes so that railings of different inner diameters can be received by the shank and the O-ring of an appropriate size selected to wedge against the railing component. And further, the seating area of the groove is wide enough to accommodate different O-rings that have different outer diameters.

In other aspects of the invention, the outer diameter of the shank is small enough to accommodate railing components of different inner diameters and the seating area of the groove is wide enough to accommodate O-rings of different outer diameters so that the O-ring can be selected depending on the difference between the outer diameter of the shank and the inner diameter of the railing component. Also, the outer diameter of the shank is slightly smaller than the inner diameter of the railing component thus providing a small interference fit.

In another aspect in accordance with the invention, the connector further comprises a fitting to which the proximal end of the shank is disposed, the fitting comprises an abutment portion located at the proximal end of the shank, the abutment portion having an outer diameter approximately equal to the outer diameter of the railing component whereby when the railing is mounted to the connector, the abutment portion provides a smooth appearance between the railing component and the connector. Also, the abutment portion limits mounting movement of the railing component in the proximal direction. Yet further, the distal end of the shank includes a chamfer thereby making it easier to receive the railing component over the shank.

Another more detailed aspect of the invention includes a railing connector comprising a shank having a plurality of annular grooves wherein each annular groove includes a bulkhead and a tapered portion with the bulkhead located closer to the proximal end and the tapered portion tapering outward toward the distal end, further comprising a plurality of O-rings, each of which has an outer diameter that is larger than the outer diameter of the shank and each of which is disposed in a respective annular groove, wherein each annular groove has a seating area with the bulkhead being located proximal to the seating area and the taper of the groove being located distal to the seating area, the seating area having a size wide enough to accommodate different O-rings that have different outer diameters.

A further aspect includes locating the abutment portion of the fitting at the proximal end of the shank to limit mounting movement of the railing component in the proximal direction, the abutment portion having an outer diameter approximately equal to the outer diameter of the railing component whereby when the railing component is mounted to the connector, the abutment portion provides a smooth appearance between the railing component and the connector, wherein when the railing component is received over the shank, each O-ring is moved against the bulkhead of the respective groove permitting the railing component to be moved proximally over the shank into contact with the abutment portion, and when the railing component is moved in the distal direction, the O-rings move up the taper of the grooves and wedge themselves against the inner surface of the railing component thereby opposing further distal movement of the railing component.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENT

Figure 1:
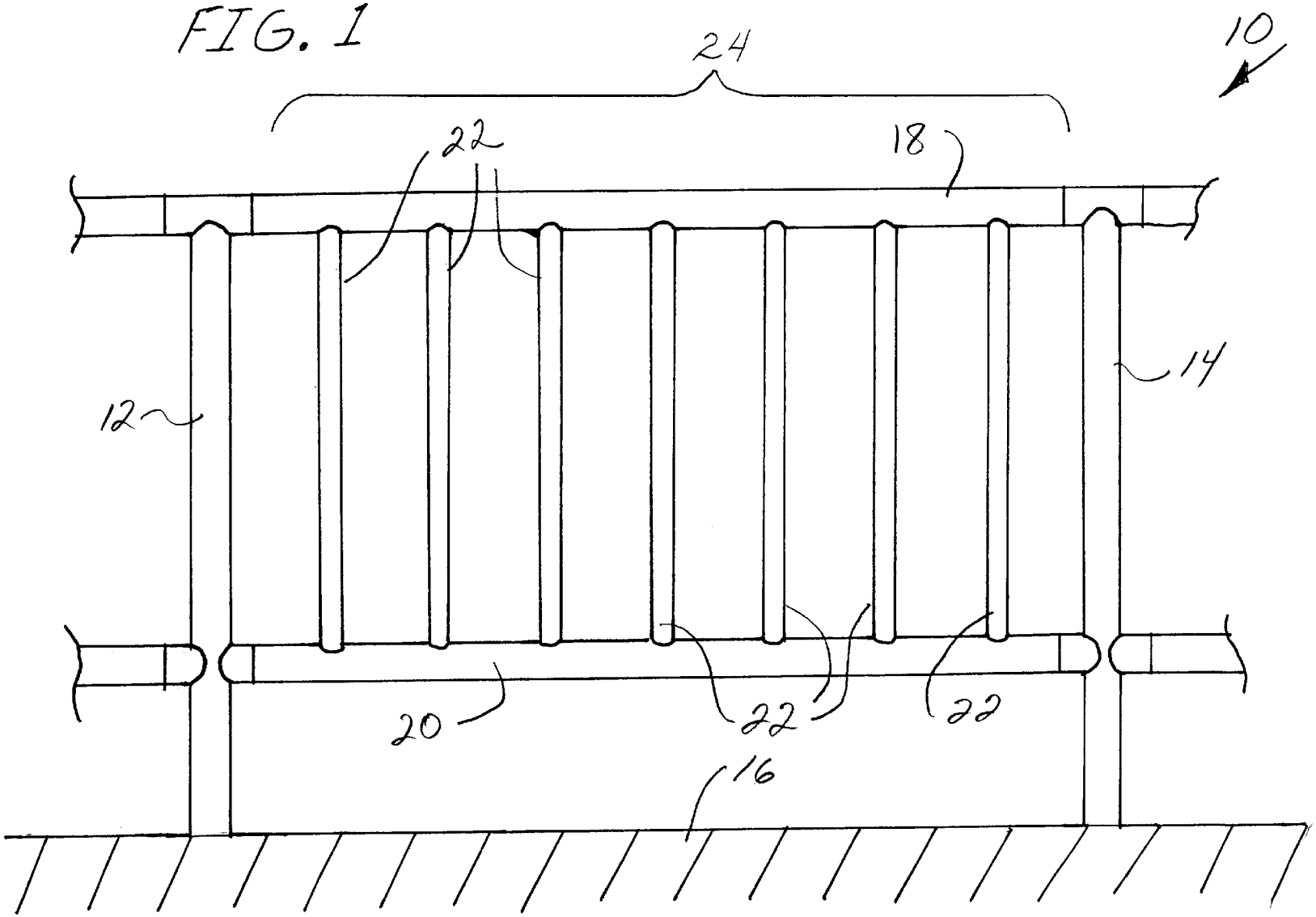
FIG. 1 is a view of a section of an assembled railing structure with a smooth appearance comprising two main vertical upright posts mounted to the ground, two main horizontal upper and lower rails, and numerous vertical intermediate rods interconnecting the upper and lower horizontal rails.

Referring now to the drawings with more particularity, wherein like reference numerals designate like or corresponding elements among the several views, there is shown in FIG. 1 an assembled railing section 10 comprising two main vertical upright mounting posts 12 and 14 mounted in a base 16. The base 16 in this case may be the ground, concrete, a deck, or other medium forming a sturdy foundation to which the railing may be anchored. Although not shown, the bottoms of each vertical post 12 and 14 may have a mounting plate welded to it with which screws or other fasteners may be used to hold the vertical posts to the base 16. Two main horizontal upper and lower rails 18 and 20 interconnect the upright posts 12 and 14, and numerous vertical intermediate rods 22 interconnect the upper and lower horizontal rails 18 and 20 at spaced-apart locations between the upright posts 12 and 14. The rails 18 and 20 in this embodiment are right cylinder tubes.

The vertical intermediate rods 22 may be permanently mounted to the upper and lower horizontal rails 18 and 20 by means such as welding. In such a case, the upper and lower horizontal railings 18 with the intermediate vertical rods 22 may be a preformed intermediate assembly 24 that is brought to the installation site as a unit. In another embodiment, the upper and lower horizontal railings 18 with the intermediate vertical rods 22 may all be brought to the installation site as individual components and assembled at the site. It is preferable that the mountings of the vertical rods 22 with the upper and lower railings 18 and 20 have smooth connections without the use of protruding fasteners, such at the heads of screws or bolts that protrude from any exterior surface of the upper railing 18 or the lower railing 20. Thus, a welded connection or other smooth type connection is preferable.

The assembly of the upper and lower horizontal railings 18 and 20 with the vertical rods 22 forms an intermediate railing assembly 24. It may have different lengths and heights, shorter or longer than the section shown, and may have different shapes. It may be straight, curved, or have sharp angles, depending on the installation required.

As alluded to briefly above, the intermediate railing assembly 24 may be assembled in a factory and shipped to an installation site. Many such assemblies 24 may be required for an installation, and all may be manufactured at a factory. Any necessary welding of the intermediate vertical rods 22 to the horizontal rails 18 and 20, and painting the entire assembly 24 may be performed at the factory. However, once the completed assemblies 24 are transported to the installation site, they must be firmly mounted to the support posts 12 and 14 to provide the necessary strength and protection desired of a railing system. As was discussed above, it is preferable for the intermediate assembly 24 to be easily and rapidly mounted to the vertical posts 12 and 14. Such mounting should be as simple as possible, as rapid as possible, involve a minimum number of tools, and involve a minimum number of parts to effect the mounting. Yet the mounting should be firm and able to withstand the specified loads.

Figure 2:
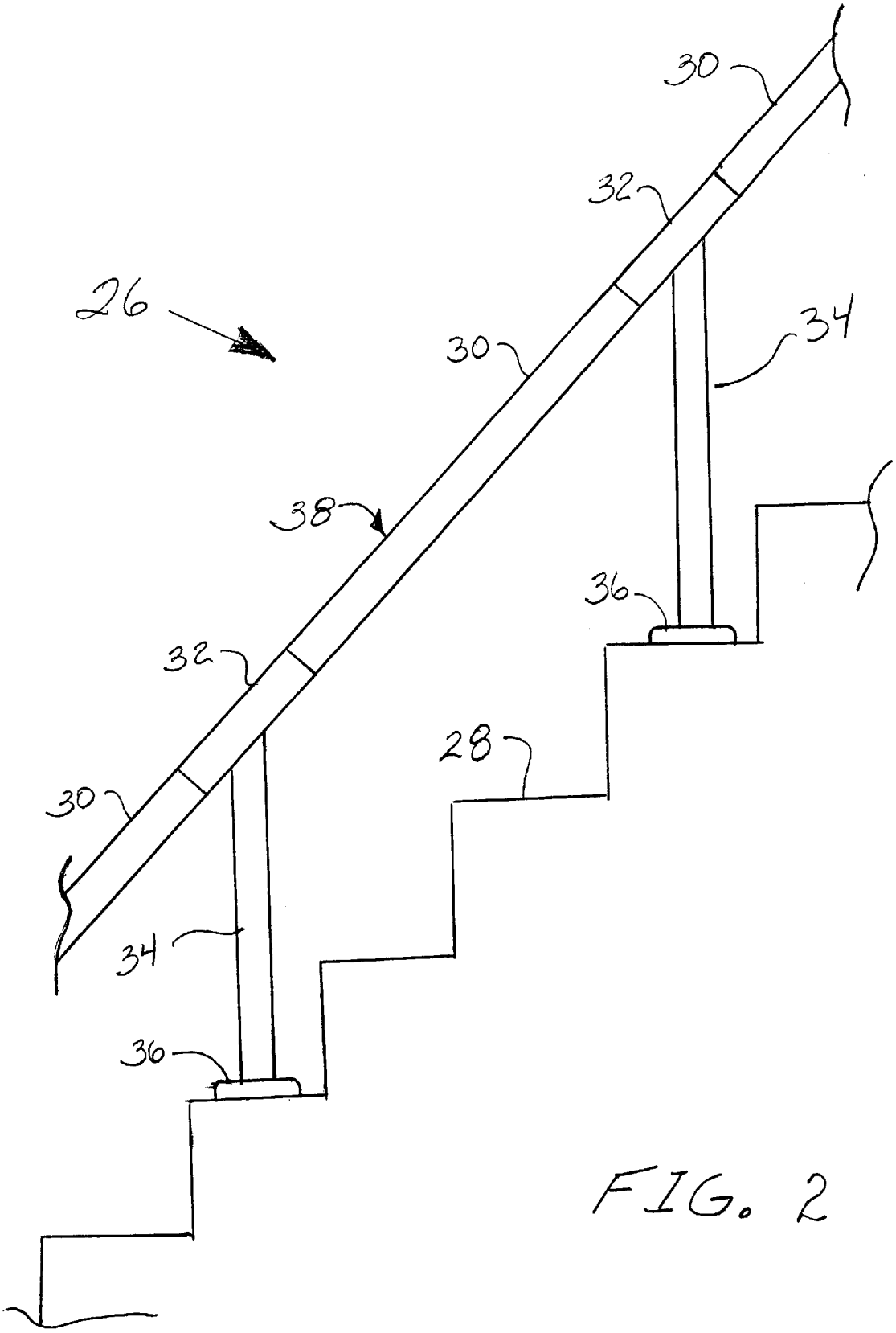
FIG. 2 presents a section of a different assembled railing structure in which a single railing is coupled to multiple vertical posts and provides a support structure for persons who traverse stairs.

FIG. 2 presents another railing structure 26 which in this case, is a hand rail mounted to stairs 28. Hand rails 30 are interconnected with connectors 32 which are mounted to vertical posts 34 mounted to the stairs 28. As shown in this figure, the bottom of each vertical post 34 has a mounting plate 36 attached to it with which screws or other fasteners may be used to hold the vertical posts to the stairs 28. Such mounting techniques are well known to those skilled in the art; hence, no further details are given here. A single hand railing 38 is used in this case and is not oriented horizontally but in this case is oriented in parallel with the path of travel of one who would use the railing 26. The user would either be ascending or descending the stairs 28 and the railing structure 26 is parallel with that path of travel. One of the features seen with the railing of FIG. 2 is a smooth appearance. No fasteners can be seen holding the rails 30 to the connectors 32. The outer diameter of the rails 30 is the same as the outer diameter of the connectors 32 thus resulting in a smooth appearance throughout the railing 38.

Figure 3:
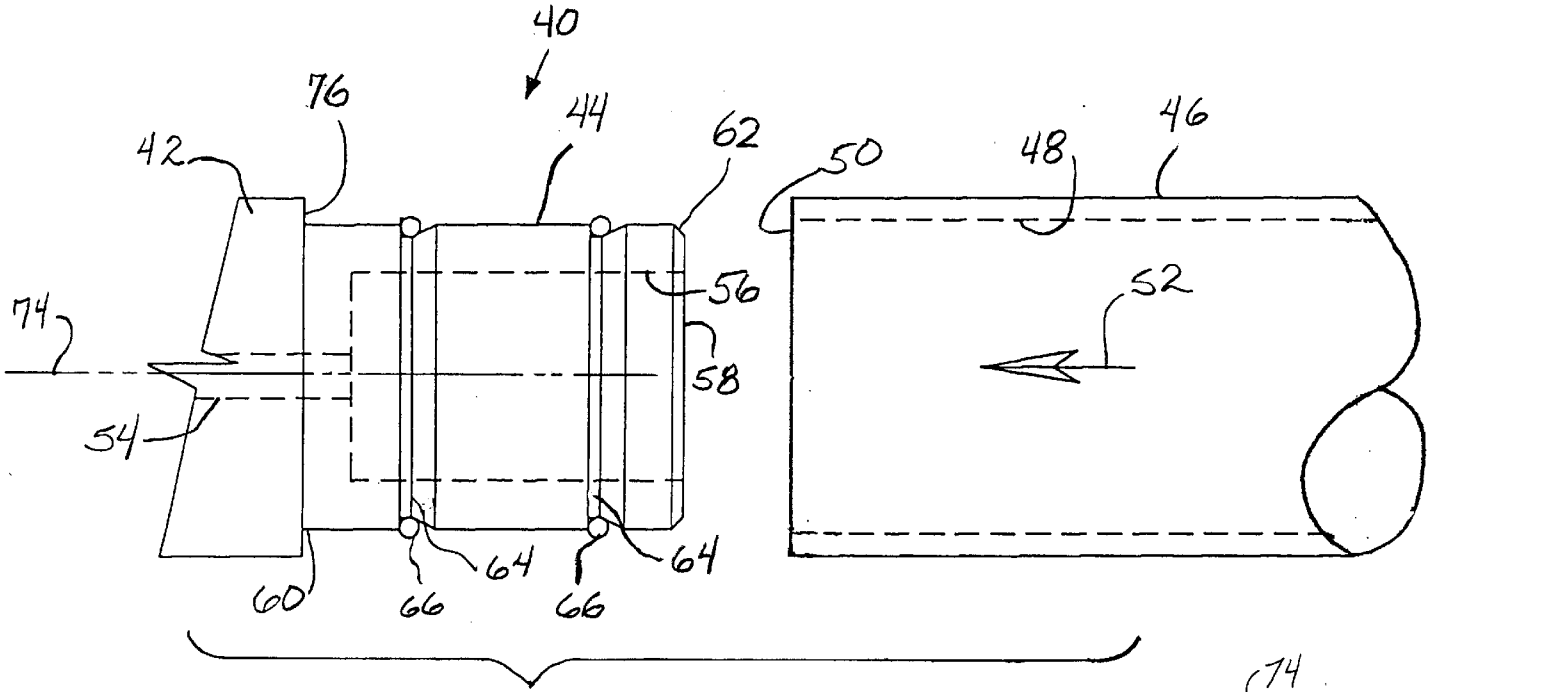
FIG. 3 presents a side view of a railing connector in accordance with aspects of the present invention for connecting with a component of a railing, the connector in this figure being mounted to one of the upright vertical posts shown in FIG. 1 or 2, and a rail being moved into engagement with the connector.

Referring now to FIG. 3, a connector 40 is shown for use in connecting components. The connector of this embodiment has two parts, a fitting 42 and a shank 44. Also shown in FIG. 3 is a railing 46 component that is to be mounted to the connector 40. The railing 46 is hollow and has an inner diameter 46 with an inner surface 46. The railing 46 is a right cylinder in this case and has a mounting end 50 to be slid over the shank 44 of the connector 40, as will be described in more detail below. The arrow 52 denotes movement in the proximal direction. The opposite direction is the distal direction. The railing may be formed of aluminum or other suitable material providing sufficient strength to accomplish its purpose. Alternatively to being hollow, it may be solid except at the ends used for mounting to connectors. Such railings are well known in the art and no further details will be provided here.

The shank 44 in this embodiment is also hollow so that it can be mounted to another device, such as one of the vertical posts shown in FIG. 1 or FIG. 2. A mounting bore 54 is formed through the fitting 42. It connects with a larger mounting bore 56 in the shank 44. The bore is larger in the shank to accommodate a mounting bolt head and washer or a washer and nut, as the case may be. The vertical post may include a bracket through which a mounting bolt through the connector 40 may engage for firmly mounting the connector 40 to the post.

Turning now to the shank 40, in this embodiment it is also cylindrical. The shank 40 has a distal end 58 and a proximal end 60. At the distal end 58, the shank has a chamfer 62 that will make it easier to initially locate the shank within the railing 46. The chamfer will guide the hollow end of the railing 46 onto the shank if the railing is placed at an angle to the shank when moved toward the shank. In this embodiment, two grooves 64 are formed in the shank 40. They are separated longitudinally from each other and in this embodiment, are substantially identical in size. More or fewer grooves may be used depending on the application.

In each groove is placed an O-ring 66. As is shown in FIG. 3, the O-ring has a diameter that is greater than the depth of the groove 66 and so protrudes above the groove. The shank 40 diameter is selected to be just slightly smaller than the inner diameter 48 of the railing 46 so that a slight interference slip fit results between the two. The size of the O-ring 66 being larger than the shank diameter provides a greater interference fit between the shank 40 and the railing 46. However, the shape of the groove 64 has been selected to permit assembly of the railing to the shank, despite the greater interference fit, yet oppose disassembly of the railing from the shank. Each groove has a bulkhead, a seating area, and a tapered portion. Such configuration is shown in more detail in FIG. 4.

Figure 4:
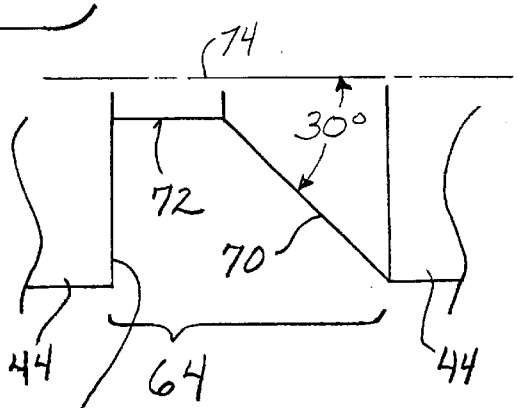
FIG. 4 is an enlarged view of the shape of a groove of the connector of FIG. 3 showing further detail.

An enlarged view of a groove 64 is shown in FIG. 4. The bulkhead 68 is located at the proximal end of the groove and the tapered portion 70 is located at the distal portion of the groove. Located between the bulkhead 68 and the tapered portion 70 is the seating area 72 where the O-ring is initially disposed before the railing is mounted to the shank. The depth of the seating area 72 is selected to accommodate the particular O-ring chosen so that the O-ring will protrude above the groove as shown in FIG. 3. Preferably, the depth of the groove is such that the O-ring will be under only minor tension, if any, when it is mounted in the groove. The seating area 72 may have a slight radius of curvature to better accommodate the O-ring. The width of the seating area 72 may vary from about the full thickness of the selected O-ring to about less than half the thickness of the O-ring. A width of about two-thirds of the thickness of the selected O-ring provides for sufficient initial seating of the O-ring and for quick roll up on the tapered portion 70, as is described below.

The depth of the groove 64 is selected so that the bulkhead will be successful in holding the O-ring in place in the groove as the railing is slid over the groove in the proximal direction for mounting. It has been found that a groove depth of approximately fifty percent of the O-ring thickness results in successful operation of the bulkhead. Greater depths may not provide enough of an interference fit of the O-ring with the railing under heavy loads and a lesser depth may cause damage to the O-ring due to too great an interference fit.

The tapered portion 70 begins at the seating area 72 and slopes upward or outward to the outer surface of the shank 44. It forms a ramp which is frustoconical in shape. The angle of taper is in the range of about 15–25 degrees from the longitudinal axis 74 of the shank 44 with about eighteen degrees being preferred. However, this angle may vary depending upon the coefficient of friction between the O-ring 66 and the railing 46 and the maximum allowable axial movement between the railing 46 and the shank 44.

O-rings 66 suitable for use with the shank 44 should have an inner diameter slightly smaller than or equal to the diameter of the seating area 72 of the groove 64. Thus, upon installation within the grooves 64, the O-rings 66 may be slightly stretched and therefore are securely retained within the grooves. Minor differences in the inside diameters of railings may be accommodated by selecting O-rings of slightly greater or lesser thickness as required. The O-rings may be made from any suitable elastomeric material, with neoprene rubber being presently preferred.

At the proximal end 60 of the shank 44, the fitting 42 forms an abutment portion 76 that serves as a positive stop for the handrail section 30 and limits mounting movement of the railing in the proximal direction 52 during insertion over the shank 44. The abutment portion 76 has an outer diameter approximately equal to the outer diameter of the railing 46 so that a smooth appearance will be presented after the railing has been mounted.

Figure 5:
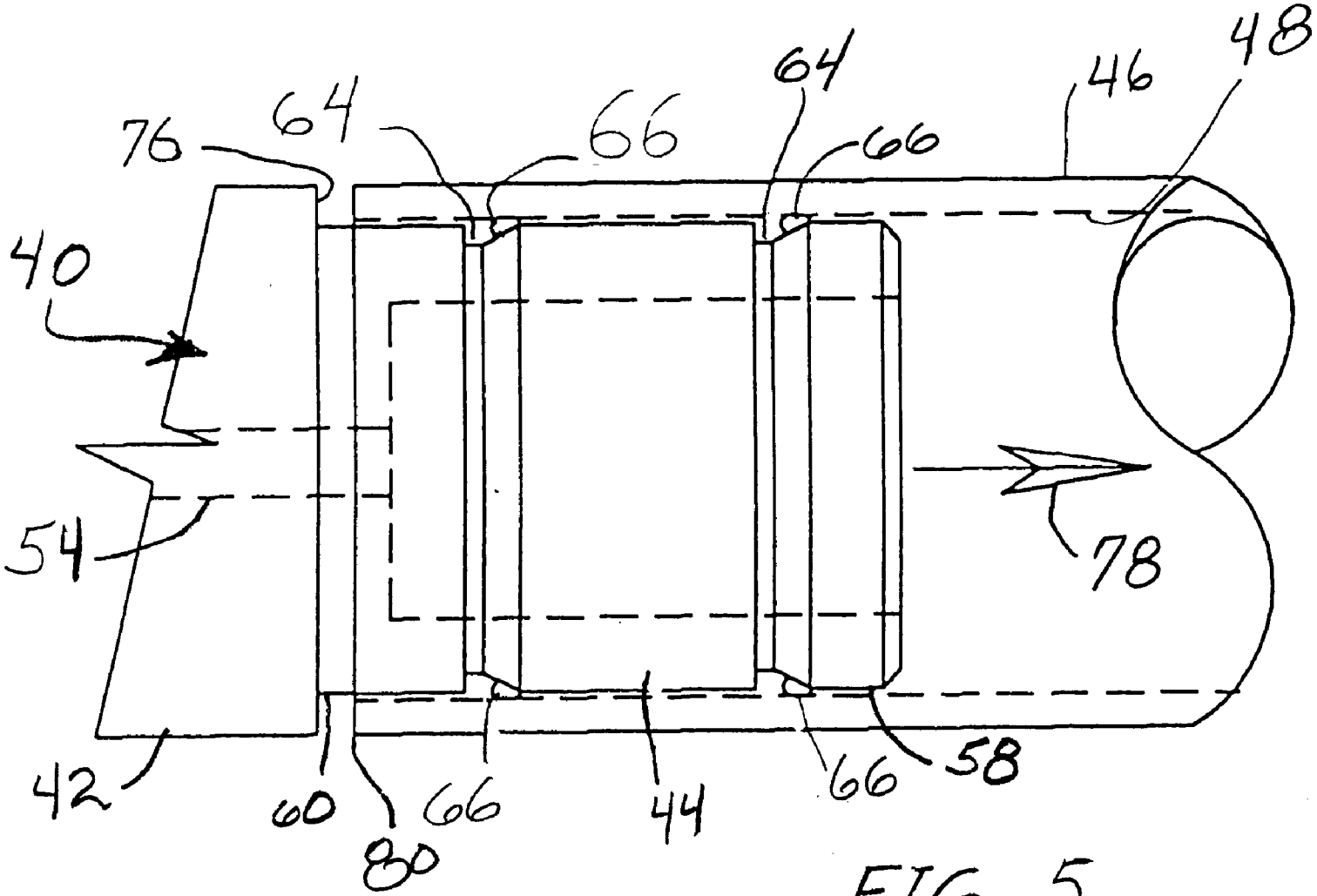
FIG. 5 is side, partial cross-sectional view of the rail engaged with the connector shown in FIG. 3 thereby forming a smooth joint in accordance with aspects of the present invention.

Referring now to FIG. 5, a view of the actual mounting of the railing 46 on the connector 40 is shown. The railing 46 was pushed over the shank 44 of the connector in the proximal direction 52 until it came into contact with the abutment portion 76, at which time further proximal movement was prevented. The chamfer 62 served as an aid in aligning the railing 46 with the shank 44. As the railing 46 was then pressed forward in the proximal direction 52 over the O-rings 66, the O-rings were pressed against the abutment portions 76 and were compressed into their respective grooves 64. The railing 46 was then pulled in the distal direction 78. As a result of pulling in the distal direction, the O-rings 66 have been pulled up the tapered portions 70 of their respective grooves 64 and have become wedged between the shank 44 and the inner surface 48 of the railing 46. The wedging action of the O-rings 66 creates high frictional forces between the shank 44 and the railing 46 and locks the railing in place on the connector 40. It is generally recommended to avoid the use of lubricants in assembling the connector 40 with the railing 46 as they will tend to reduce the locking frictional force.

The gap 80 between the mounting end 50 of the railing 46 and the abutment portion 76 is slight and is generally insignificant. A larger O-ring 66 would make the gap 80 smaller while a smaller O-ring will make the gap larger. However, the use of a larger O-ring makes it more difficult to move the railing 46 in the proximal direction 52 during mounting. A smaller O-ring may not develop the frictional forces necessary with the inner surface of the railing 48 to be drawn up the tapered portion 70 of the groove 64 as the railing is pulled in the distal direction 78. All of the foregoing considerations also depend on the clearance between the inner surface of the railing and the shank. Therefore, it has been found to be useful to have on hand O-rings of different sizes when assembling the railing 46 to the connector 40. The grooves 64 are formed wide enough to accommodate O-rings of different sizes and the optimum one is chosen depending on the clearance between the inner surface of the railing and the shank.

For ease of illustration, only two O-rings and O-ring grooves are illustrated in the figures. However, it should be understood that additional O-rings and grooves may be used with each additional O-ring and groove increasing the frictional locking force produced by the wedging action of the O-rings.

In the embodiments shown, the assembly of the railing 46 to the connector 40 is a permanent assembly. Additionally, the compressed O-rings provide a seal against the ingress of fluids into the connector and railing.

Figure 6:
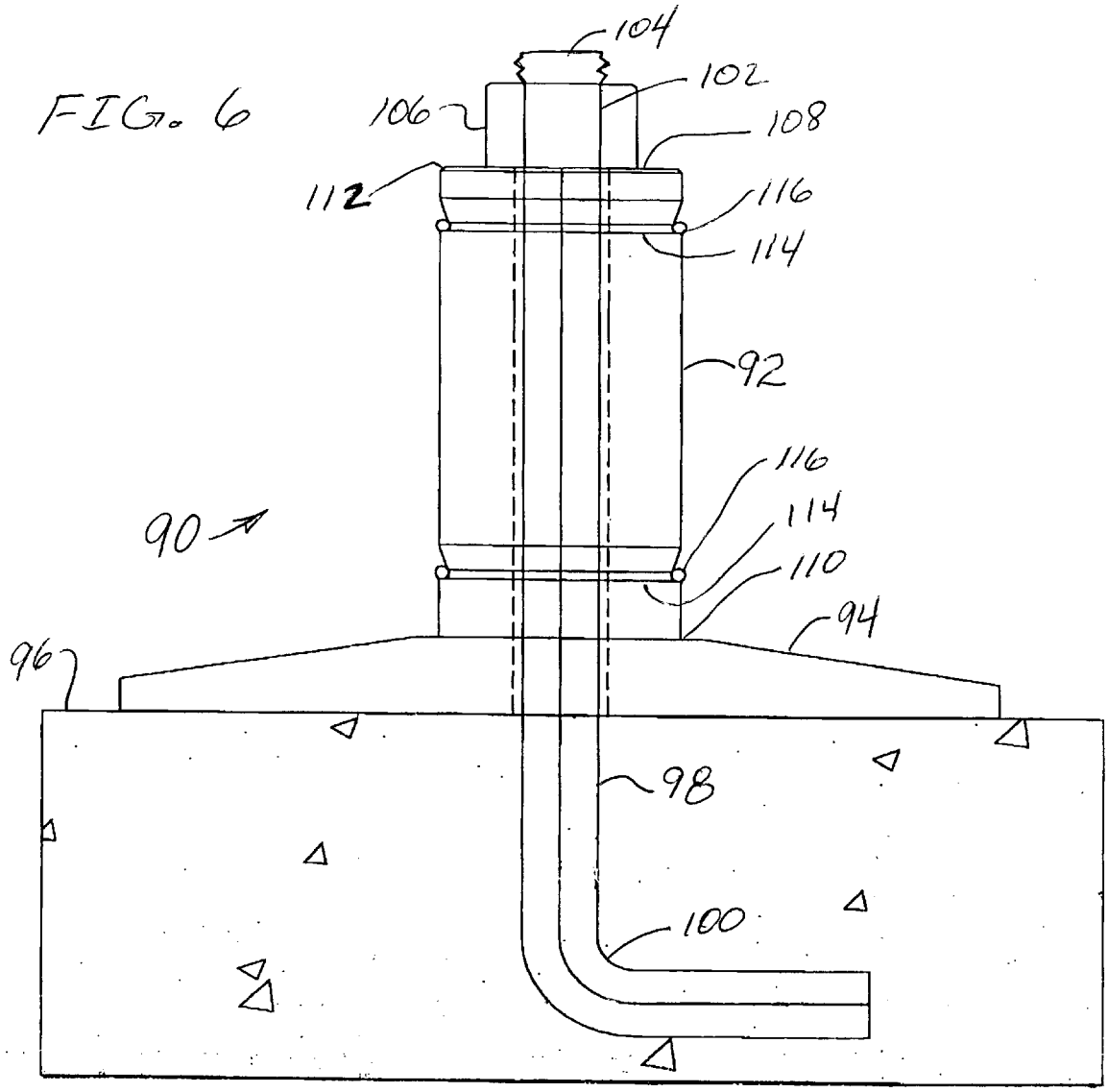
FIG. 6 is a view of a railing connector in accordance with aspects of the invention mounted to a concrete base by means of an anchor bolt, the railing connector being adapted to receive a post to securely mount the post to the concrete base.

The connector in accordance with aspects of the invention may be used to connect other components. Turning now to FIG. 6, it will be seen that the connector 90 comprises a shank 92 mounted to an escutcheon 94. The connector 90 and escutcheon are mounted to a concrete base 96 through the use of a cast-in-place anchor bolt 98. In this case the anchor bolt 98 includes a right angle 100 that assists in permanently anchoring the bolt in the concrete base. The shank 92 and the escutcheon are hollow having a channel through each of them large enough to accommodate the anchor bolt. The anchor bolt has a threaded portion 102 at its distal end 104 and a nut 106 is threaded to the threaded portion to secure the connector 90 and escutcheon 94 to the concrete base 96.

The shank 92 of the connector 90 of FIG. 6 includes a distal end 108 and a proximal end 110. At the distal end 108, the shank has a chamfer 112 as in FIG. 3 that will make it easier to initially locate the shank within the railing component to which it is to be mounted. The chamfer will guide the hollow end of the railing component onto the shank if the component is placed at an angle to the shank when moved toward the shank. In this embodiment, two grooves 114 are formed in the shank 92. They are separated longitudinally from each other as in a previous embodiment and are substantially identical in size. More or fewer grooves may be used depending on the application. In each groove is placed an O-ring 116, also as in a previous embodiment. The size and shape of the grooves and the size of the O-rings are selected according to principles already discussed above.

In the case of FIG. 6, the railing connector 90 is used to connect a different railing component. A post similar to that shown in FIG. 1 and having numeral 12 will be mounted over the connector 90 to secure the post in position on the concrete base. It should be appreciated that the connector shown in the various figures may be used to connect various components; only two examples have been given above.

The connector 40 may be made from any suitable material, produced by any suitable process, examples of which are drawn or extruded aluminum, steel, and plastic, with aluminum alloy 6063 being presently preferred.

Thus, in accordance with the invention, a new and useful connector is provided for assembling tubular handrail structures. A fitting provides shaped O-ring grooves to lock railing components together through O-ring wedging action. In this manner, the fitting allows for the quick and simple on-site construction of handrail structures with an integrated seamless appearance without requiring the use of welding or adhesive bonding or the use of bolts that may protrude from the connecting structure and pose a safety hazard. The connector in accordance with the invention is easy to manufacture and is less expensive than connectors using threaded structures or other interconnecting means. O-rings are relatively inexpensive and are readily available.

Although specific embodiments of the invention have been described and illustrated, it is clear that the invention is susceptible to numerous modifications and embodiments within the ability of those skilled in the art, and without the exercise of inventive faculty. Thus, it should be understood that various changes in form, detail and application of the present invention may be made without departing from the spirit and scope of the invention.

What is claimed is:

1. A railing assembly comprising:

a railing component having a hollow segment with an inner diameter and a substantially unbroken inner surface;

a shank having an outer diameter that is less than the inner diameter of the railing component and a proximal end and a distal end for receiving the railing component over the shank, the shank having an annular groove; and an O-ring disposed in the annular groove and having an outer diameter that is larger than the outer diameter of the shank and larger than the inner diameter of the hollow segment of the railing component so as to establish an interference fit with the unbroken inner surface;

wherein the annular groove includes a bulkhead and a tapered portion, the bulkhead located closer to the proximal end and the tapered portion tapering outward toward the distal end, and further includes a seating area with the bulkhead being located proximal to the seating area and the tapered portion of the groove being located distal to the seating area, the seating area having a width within the range of about one half to about the full outer diameter of the O-ring;

wherein when the railing component is received over the shank, the O-ring is moved against the bulkhead of the groove due to the interference fit with the unbroken inner surface of the hollow segment as the railing component is moved over the shank toward the proximal end into a selected mounting position and when the railing component is moved toward the distal end, the O-ring moves up the tapered portion of the groove due to the interference fit with the unbroken surface of the hollow segment and is wedged between the inner surface of the railing component and the tapered portion thereby opposing further movement of the railing component toward the distal end.

2. A railing assembly comprising:

a railing component having a hollow segment with an inner diameter and a substantially unbroken inner surface;

a shank having an outer diameter that is less than the inner diameter of the railing component and a proximal end and a distal end for receiving the railing component over the shank, the shank having an annular groove;

wherein the annular groove includes a bulkhead and a tapered portion, the bulkhead located closer to the proximal end and the tapered portion tapering outward toward the distal end, an O-ring disposed in the annular groove and having an outer diameter that is larger than the outer diameter of the shank and larger than the inner diameter of the hollow segment of the railing component so as to establish an interference fit with the unbroken inner surface;

wherein when the railing component is received over the shank, the O-ring is moved against the bulkhead of the groove due to the interference fit with the unbroken inner surface of the hollow segment as the railing component is moved over the shank toward the proximal end into a selected mounting position and when the railing component is moved toward the distal end, the O-ring moves up the tapered portion of the groove due to the interference fit with the unbroken surface of the hollow segment and is wedged between the inner surface of the railing component and the tapered portion thereby opposing further movement of the railing component toward the distal end; and a fitting to which the proximal end of the shank is disposed, wherein the fitting comprises an abutment portion located at the proximal end of the shank, the abutment portion having an outer diameter approximately equal to the outer diameter of the railing component whereby when the railing component is mounted to the connector, the abutment portion provides a smooth appearance between the railing component and the connector.

3. A railing assembly comprising:

a railing component having a hollow segment with an inner diameter and a substantially unbroken inner surface;

a shank having an outer diameter that is less than the inner diameter of the railing component and a proximal end and a distal end for receiving the railing component over the shank, the shank having an annular groove;

wherein the annular groove includes a bulkhead and a tapered portion, the bulkhead located closer to the proximal end and the tapered portion tapering outward toward the distal end, an O-ring disposed in the annular groove and having an outer diameter that is larger than the outer diameter of the shank and larger than the inner diameter of the hollow segment of the railing component so as to establish an interference fit with the unbroken inner surface;

wherein when the railing component is received over the shank, the O-ring is moved against the bulkhead of the groove due to the interference fit with the unbroken inner surface of the hollow segment as the railing component is moved over the shank toward the proximal end into a selected mounting position and when the railing component is moved toward the distal end, the O-ring moves up the tapered portion of the groove due to the interference fit with the unbroken surface of the hollow segment and is wedged between the inner surface of the railing component and the tapered portion thereby opposing further movement of the railing component toward the distal end; and a fitting to which the proximal end of the shank is disposed, wherein the fitting comprises an abutment portion located at the proximal end of the shank, the abutment portion having an outer diameter approximately equal to the outer diameter of the railing component whereby the abutment portion limits mounting movement of the railing component toward the proximal end whereby when the railing component is mounted to the connector, the abutment portion provides a smooth appearance between the railing component and the connector.

4. A railing assembly comprising:

a railing component having a hollow segment with an inner diameter and a substantially unbroken inner surface;

a fitting having an abutment portion;

a shank disposed on the fitting, the shank having an outer diameter that is less than the inner diameter of the railing component and a proximal end located towards the fitting and a distal end located away from the fitting for receiving the railing component over the shank, the shank having an annular groove;

wherein the annular groove includes a bulkhead and a tapered portion, the bulkhead located closer to the fitting and the tapered portion tapering outward toward the distal end;

an O-ring disposed in the annular groove and having an outer diameter that is larger than the outer diameter of the shank and larger than the inner diameter of the hollow segment of the railing component so as to establish an interference fit with the unbroken inner surface;

wherein the annular groove has a seating area, the bulkhead being located proximal to the seating area and the tapered portion of the groove being located distal to the seating area, the seating area having a size selected to receive the O-ring;

wherein the abutment portion is located at the proximal end of the shank and limits mounting movement of the railing component toward the proximal end, and has an outer diameter approximately equal to the outer diameter of the railing component whereby when the railing component is mounted to the fitting, the abutment portion provides a smooth appearance between the railing component and the fitting; and wherein when the railing component is received over the shank and is moved toward the abutment portion, the O-ring is moved against the bulkhead of the groove due to the interference fit with the unbroken inner surface of the hollow segment as the railing component is moved proximally over the shank into contact with the abutment portion and when the railing component is moved toward the distal end, the O-ring moves up the tapered portion of the groove due to the interference fit with the unbroken surface of the hollow segment and is wedged between the inner surface of the railing component and the tapered portion thereby opposing further distal movement of the railing component.

5. A railing assembly comprising:

a railing component having a hollow segment with an inner diameter and a substantially unbroken inner surface;

a fitting having an abutment portion;

a shank disposed on the fitting, the shank having an outer diameter that is less than the inner diameter of the railing component and a proximal end located towards the fitting and a distal end located away from the fitting for receiving the railing component over the shank, the shank having a plurality of annular grooves;

wherein each annular groove includes a bulkhead and a tapered portion, the bulkhead located closer to the fitting and the tapered portion tapering outward toward the distal end;

further comprising a plurality of O-rings disposed in the plurality of annular grooves and each of which has an outer diameter that is larger than the outer diameter of the shank and larger than the inner diameter of the hollow segment of the railing component so as to establish an interference fit with the unbroken inner surface;

wherein each annular groove has a seating area, the bulkhead being located proximal to the seating area and the tapered portion of the groove being located distal to the seating area, the seating area having a size wide enough to accommodate different O-rings that have different outer diameters;

wherein the abutment portion is located at the proximal end of the shank and limits mounting movement of the railing component toward the proximal end, the abutment portion having an outer diameter approximately equal to the outer diameter of the railing component whereby when the railing component is mounted to the fitting, the abutment portion provides a smooth appearance between the railing component and the fitting; and wherein when the railing component is received over the shank, each O-ring is moved against the bulkhead of the respective groove due to the interference fit with the unbroken inner surface of the hollow segment as the railing component is moved proximally over the shank into contact with the abutment portion, and when the railing component is moved toward the distal end, the O-rings move up the tapered portion of the grooves due to the interference fit with the unbroken surface of the hollow segment and are wedged between the inner surface of the railing component and the tapered portion thereby opposing further distal movement of the railing component.

* * * * *